US008853656B2

(12) United States Patent
Yanagida et al.

(10) Patent No.: US 8,853,656 B2
(45) Date of Patent: Oct. 7, 2014

(54) EXTREME ULTRAVIOLET LIGHT SOURCE DEVICE

(75) Inventors: Tatsuya Yanagida, Hiratsuka (JP); Masaki Nakano, Yokohama (JP); Akira Endo, Tokyo (JP)

(73) Assignee: Gigaphoton Inc., Tochigi (JP)

( * ) Notice: Subject to any disclaimer, the term of this patent is extended or adjusted under 35 U.S.C. 154(b) by 298 days.

(21) Appl. No.: 12/535,014

(22) Filed: Aug. 4, 2009

(65) Prior Publication Data

US 2010/0025223 A1 Feb. 4, 2010

(30) Foreign Application Priority Data

Aug. 4, 2008 (JP) ..... 2008-201263
Jul. 30, 2009 (JP) ..... 2009-177822

(51) Int. Cl.
*H05G 2/00* (2006.01)

(52) U.S. Cl.
CPC ..... *H05G 2/003* (2013.01); *H05G 2/006* (2013.01); *H05G 2/005* (2013.01); *H05G 2/008* (2013.01)
USPC ..... 250/504 R; 250/493.1

(58) Field of Classification Search
None
See application file for complete search history.

(56) References Cited

U.S. PATENT DOCUMENTS 4,075,488 A * 2/1978 Okayama et al. ..... 250/396 R
7,227,618 B1 * 6/2007 Bi ..... 355/67
2002/0140383 A1 * 10/2002 Ogasawara ..... 315/364
2004/0188630 A1 * 9/2004 Brunner et al. ..... 250/396 R
2005/0147147 A1 * 7/2005 Umstadter et al. ..... 372/73
2005/0162762 A1 * 7/2005 Novak ..... 359/849
2005/0199829 A1 9/2005 Partlo et al.
2006/0186356 A1 * 8/2006 Imai et al. ..... 250/504 R
2006/0192154 A1 * 8/2006 Algots et al. ..... 250/504 R
2006/0193065 A1 * 8/2006 Novak ..... 359/849
2007/0170377 A1 7/2007 Nakano
2008/0035865 A1 * 2/2008 Komori et al. ..... 250/504 R
2008/0048133 A1 2/2008 Bykanov et al.
2008/0283776 A1 * 11/2008 Algots et al. ..... 250/492.1

FOREIGN PATENT DOCUMENTS

JP 2007200615 A 8/2007

* cited by examiner

*Primary Examiner* — Andrew Smyth

(74) *Attorney, Agent, or Firm* — McDermott Will & Emery LLP

(57) ABSTRACT

Offset in the ejection direction of target material droplets is corrected in order to stabilize EUV output in an EUV light source device. An extreme ultraviolet light source device includes a droplet generation device 110 that outputs target material droplets 101 towards a predetermined plasma emission point 103; a charging device 130 that charges the target material droplets 101; a trajectory correction device 140 that generates a force field in the trajectory to correct the travel direction of the charged target material droplets 101*a* so that the charged target material droplets 101*a* travel towards the plasma emission point 103; and a laser light source 150 that irradiates, at the plasma emission point 103, a laser beam onto the charged target material to generate plasma thereby.

15 Claims, 17 Drawing Sheets

EXTREME ULTRAVIOLET LIGHT SOURCE DEVICE

CROSS-REFERENCE TO RELATED APPLICATION(S)

This application claims priority to Japanese JP2008-201263, filed Aug. 4, 2008, and JP 2009-177822, filed Jul. 30, 2009. The entire contents of the above identified applications are incorporated herein by reference.

TECHNICAL FIELD

The present invention relates to an extreme ultraviolet light source device that generates extreme ultraviolet (EUV) light by irradiating a laser beam onto a target material.

BACKGROUND OF INVENTION

A typical EUV light source device that generates extreme ultraviolet light in a conventional way (shown as a simple schematic diagram in FIG. 15) includes an EUV chamber that is kept in a vacuum, and a device for droplet generation that ejects droplets of a target material which radiates EUV when turned into plasma. The target material is turned into plasma through irradiation of a pulsed driver laser, whereupon the EUV light radiated by the plasma is focused to a focal point by way of a collector mirror. The focused EUV light propagates next into a semiconductor exposure device using EUV light, and is eventually guided onto a semiconductor wafer.

The position of the focal point is a predetermined position in the semiconductor exposure device. Accordingly, the EUV generation point must be fixed at a predetermined position within the EUV light source. That is, the driver laser and the target material droplets must interact (i.e. the target material droplets must be irradiated by the laser beam) at the EUV generation point at all times.

Examples of the target material include, for instance, liquid metal from Sn, Li, or the like, melted through heating at a temperature at or above the melting point (Sn: 232° C., Li: 180° C.), or a dispersion of micro-particles of Sn, $SnO_2$, or the like, in a solvent such as water or alcohol.

Generation of target material droplets in the droplet generation device is beset by the following problems. The nozzle that forms the droplets may become clogged on account of changes in the surface condition of the nozzle, or through intrusion of impurity particles into a flow channel. When using liquid metal in the target material, moreover, a target material at high temperature flows through the nozzle, which may give rise to thermal deformation of the nozzle. As a result, the ejection direction of target material droplets from the droplet generation device becomes unstable, which may preclude supplying target material droplets stably to the point of interaction with the laser beam, i.e. the EUV generation point. EUV light cannot be generated stably when such problems occur.

Methods such as the one disclosed in, for instance, US 2005/0199829 A1 attempt to solve the above problems.

Other proposed methods involve selectively charging some of the small droplets that are continuously jetted out of a droplet generation device and deflecting the charged droplets by way of a parallel electric field, in order to widen the spacing between the small droplets, so that only charged droplets are taken out of the droplet stream and are supplied to the EUV generation point. (Japanese Patent Application Laid-open No. 2007-200615 and US 2008/0048133 AI).

In US 2005/0199829 A1, the position of target material droplets is monitored by a plurality of position sensors (CCD cameras, or the like). When the droplet position is offset from the EUV generation point, the droplet generation device is displaced, on the basis of information regarding that offset, in such a manner that the droplets pass through the original EUV generation point. Displacement of the droplet generation device is accomplished, for instance, by way of a droplet generation device position control device employing a stepping motor, or the like, and mounted on the droplet generation device. FIG. 16 illustrates schematically an instance of droplet position correction based on the abovementioned prior art method. The position sensor of target material droplets and the position control mechanism of the droplet generation device are omitted from FIG. 16.

Changes in the ejection direction of the droplets can be corrected by controlling the motion of the droplet generation device itself, so long as the change is comparatively slow, for instance, a drift-like direction change. However, the control of the droplet generation device cannot cope with instantaneous direction changes that occur faster than the time interval at which the motion direction of the droplet generation device is controlled (for instance, 0.03 s). Therefore, in the above method, as well, there exists a time window during which droplets do not pass through the laser irradiation point, and hence the problem of unstable EUV output remains unresolved.

A further drawback is that the method requires, for instance, equipment for measuring droplet position, and a control mechanism, a controller, or the like, for controlling the motion of the target generator, as described above, all of which results in an overall larger EUV device.

In case of changes in the ejection direction of droplets from the droplet generation device, droplets deflected by way of a deflecting electrode may fail to pass through the EUV generation point, as illustrated in FIG. 17, which results in the same problem of unstable EUV output, even when using the droplet selection techniques disclosed in Japanese Patent Application Laid-open No. 2007-200615 and US 2008/0048133 A1 as offset correction schemes that rely on displacing the droplet generation device, as described above.

SUMMARY OF THE INVENTION

Therefore, it is the object of the present invention to correct offset in the ejection direction of target material droplets, and to thereby stabilize EUV output, in an EUV light source device.

The present invention is an extreme ultraviolet light source device which radiates extreme ultraviolet light by turning a target material into plasma, comprising a droplet generation device that generates target material droplets, and outputs the generated target material droplets towards a predetermined plasma emission point; a charge supply device that charges the target material droplets outputted by the droplet generation device; a trajectory correction device that generates a force field for correcting the trajectory of the target material droplets charged by the charge supply device, the force field exerting a force on the charged target material droplets in such a manner that the charged target material droplets travel towards the plasma emission point in response to the force; and a laser light source that irradiates a laser beam onto the charged target material droplets at the plasma emission point, to turn the target material into plasma.

The trajectory correction device may form the force field in such a manner that the charged target material droplets passing through a predetermined point upstream of the force field, on a straight line that joins a droplet output point of the droplet generation device and the plasma emission point, are focused the plasma emission point.

The force field generated by the trajectory correction device may be an electric field. The electric field generated by the trajectory correction device may function as an electrostatic lens.

The trajectory correction device may have a circular hole electrode or a tubular electrode, and the electric field is generated by the circular hole electrode or by the tubular electrode.

The trajectory correction device may comprise a quadrupole electrode, and the electric field is generated by the quadrupole electrode. The force field generated by the trajectory correction device may be a magnetic field. The magnetic field generated by the trajectory correction device may function as a magnetic lens.

The trajectory correction device may comprise a quadrupole magnet, and the magnetic field is generated by the quadrupole magnet.

A deflection device may be provided between the charge supply device and the trajectory correction device, so that the charge supply device selectively charges target material droplets outputted by the droplet generation device, and the deflection device selects target material droplets outputted by the droplet generation device in such a manner that only target material droplets charged by the charge supply device are supplied to the trajectory correction device.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

An extreme ultraviolet light source device 1 according to an embodiment of the present invention will be explained next with reference to accompanying drawings, wherein like reference numbers refer to like components.

Figure 1:
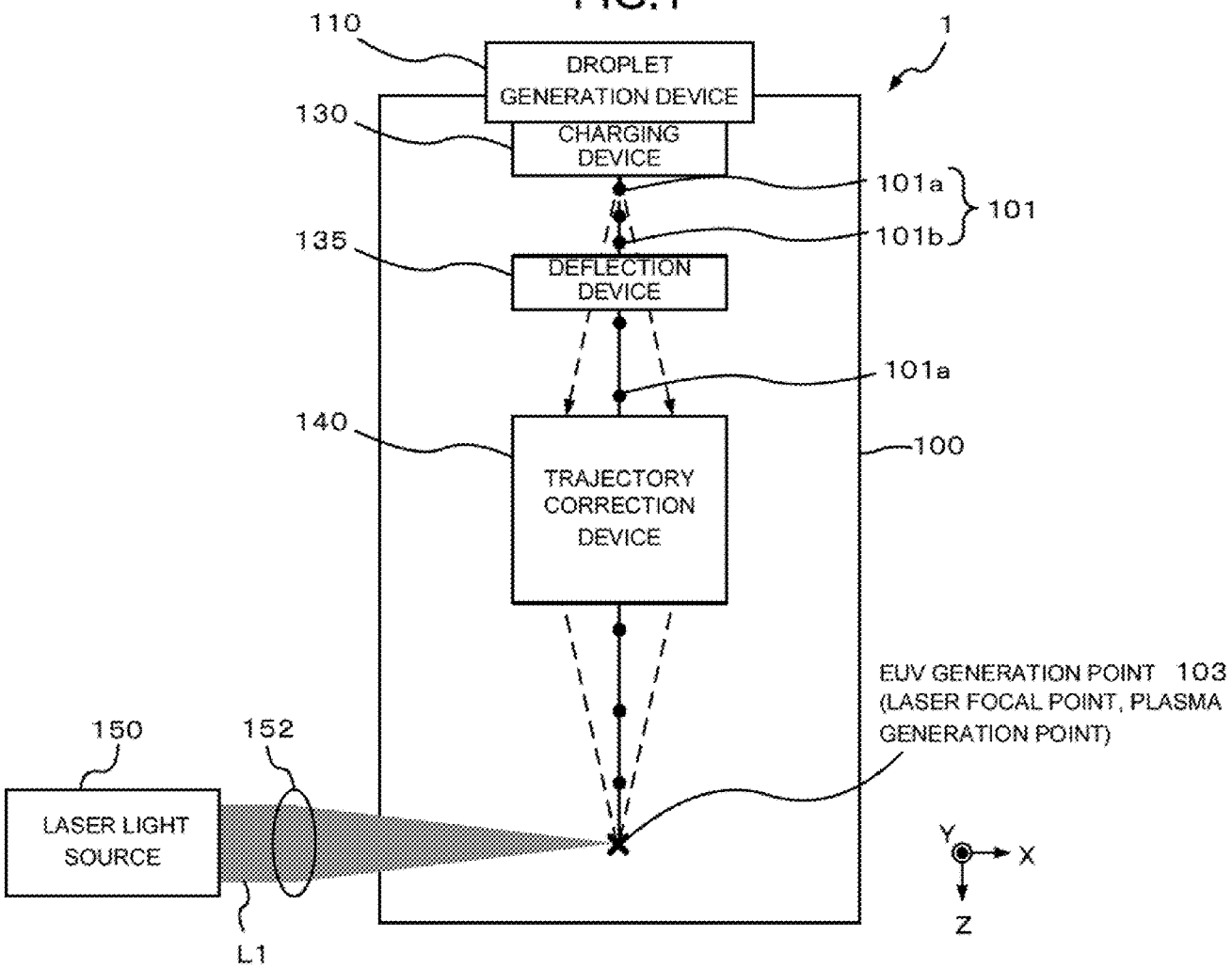
FIG. 1 illustrates schematically a portion of an extreme ultraviolet light source device 1 according to an embodiment of the present invention.

FIG. 1 is a diagram illustrating schematically part of an extreme ultraviolet light source device 1 according to the present embodiment. The EUV light source device 1 is of LPP type (laser-produced plasma), and includes an EUV chamber 100; a droplet generation device 110 that generates droplets 101 of a target material and causes the droplets to drop into the EUV chamber 100; a laser light source 150 that generates laser beams that are irradiated onto the droplets 101 of the target material within the EUV chamber 100; and a lens 152 that focuses a laser beam L1, emitted by the laser light source 150, to a predetermined EUV generation point (laser focal point, plasma generation point) 103.

A charging device 130, a deflection device 135 and a trajectory correction device 140 are disposed in the EUV chamber 100, in the trajectory of the dropping droplets 101 jetted by the droplet generation device 110. The charging device 130 selects, at appropriate intervals, droplets 101 continuously dropping from the droplet generation device 110, and electrically charges the selected droplets. The deflection device 135 deflects the trajectory of droplets 101*a* charged by the charging device 130, to select the charged droplets 101*a* from uncharged droplets 101*b*. The trajectory correction device 140 corrects the travel direction of the charged droplets 101*a* deflected by the deflection device 135 so as to direct the droplets towards an EUV generation point 103. The interior of the EUV chamber 100 is evacuated by a vacuum pump is not shown.

The droplet generation device 110 has a nozzle provided with a piezoelectric element (not shown). When the piezoelectric element is driven to oscillate upon reception of a predetermined driving signal, target material supplied to the nozzle is turned into droplets 101 at the leading end of the nozzle, out of which the droplets are continuously outputted into the EUV chamber 100. Examples of the material that can be used as the target material include, for instance, molten metal such as molten tin (Sn) or lithium (Li); a dispersion of small metal particles of tin, tin oxide or copper in water or alcohol; or an ionic solution of lithium fluoride (LiF) or lithium chloride (LiCl) dissolved in water. The present embodiment is explained using molten tin (Sn) as the target material, but other target material may be used instead.

The piezoelectric element imparts oscillation of a predetermined frequency "f" to the nozzle, through extension and contraction of the element on the basis of a driving signal supplied by a piezo driver (not shown). Target material droplets 101 repeatedly dropping out of the nozzle can thus be generated through disturbance of the flow of target material outputted by the nozzle (target jet). Specifically, ideal droplets of uniform size are formed when predetermined conditions are satisfied (for instance, $\lambda/d=4.511$, wherein v is the target jet speed, $\lambda$ ($\lambda=v/f$) is the wavelength of the oscillations generated in the target jet, and d is the diameter of the target jet. The frequency "f" of the disturbances created in the target jet is called the Rayleigh frequency. In practice, droplets of substantially uniform size are formed when λ/d is about 3 to 8. The speed v of target jets outputted from nozzles ordinarily used in EUV light source devices ranges from about 20 m/s to about 30 m/s. Thus, the frequency to be imparted to the nozzle ranges from about several tens of kHz to about several hundreds of kHz, when forming droplets having a diameter of about 10 μm to about 100 μm. Hereafter, the number of droplets thus generated per second will be referred to as the droplet generation frequency, or simply generation frequency.

The charging device 130 has a charging electrode and a charging power source (not shown). The charging electrode applies positive or negative charge, supplied from the charging power source, to the target material droplets 101 generated by the droplet generation device 110, to charge the droplets thereby. The charging device 130 selects some of the target material droplets 101 generated by the droplet generation device 110, and charges only selected droplets 101*a*, leaving uncharged the droplets 101*b* that are not selected.

The charging device 130 selects droplets 101*a* to be charged, for instance, as follows. As described above, the generation frequency of the droplets 101 ranges ordinarily from about several tens of kHz to about several hundreds of kHz, whereas the repetition frequency required from ordinary EUV light sources is ordinarily of about 10 kHz. Therefore, the droplets 101 are selected and charged in such a manner that the timing with which the droplets 101 pass through the EUV generation point 103 matches the repetition operation frequency of a laser light source. When for instance the generation frequency of the droplets 101 is 100 kHz and the lasing frequency is 10 kHz, then there may be charged one in ten droplets 101. That is, the charging device 130 repeats an operation of letting nine successive droplets 101*b* go past, and then charging one droplet 101*a*.

The deflection device 135 has a deflecting electrode and a deflection power source (not shown). Upon being supplied with power from the deflection power source, the deflecting electrode generates an electric field in the trajectory of the droplets 101. As the droplets 101 pass through the electric field, only the charged droplets 101*a* are deflected, on account of the force exerted by the electric field. That is, the deflection device 135 selects only the charged droplets 101*a* and deflects the travel direction of the charged droplets 101*a*. As a result, the droplets 101 dropping from the droplet generation device 110 can be spaced out by causing the travel direction of the deflected droplets 101*a* to be directed towards the trajectory correction device 140.

The trajectory correction device 140 corrects the trajectory of the charged target material in such a manner that the charged droplets 101*a* travel towards the EUV generation point 103. For instance, the trajectory correction device 140 generates a force field for correcting the trajectory of the charged target material, i.e. a field for exerting a force on the target material droplets 101*a* charged by the charging device (charge supplying device) 130, in such a manner that the charged droplets 101*a* travel, through the action of this force, towards the EUV generation point 103. The force field generated by the trajectory correction device 140 may be an electric field or a magnetic field. The trajectory correction device 140 may include, for instance, electrodes for forming an electric field, or magnets and a power source (not necessary in case of permanent magnets) for generating a magnetic field.

Herein, the term "ideal trajectory" denotes a trajectory, from among the trajectories of the droplets 101*a* passing through the trajectory correction device 140, that extends in a straight line from the droplet output point of the droplet generation device 110, the charging device 130 or the deflection device 135, up to the EUV generation point (plasma generation point) 103, and which requires no correction by the trajectory correction device 140. Alternatively, the "ideal trajectory" denotes a trajectory on the straight line that joins the droplet output point of the droplet generation device 110 and the EUV generation point 103. The trajectory correction device 140 generates an electric field or a magnetic field in such a manner that droplets 101*a* passing through a predetermined point on the ideal trajectory, upstream of the generated field, are caused to converge towards the EUV generation point 103. That is, droplets 101*a* deviating from the ideal trajectory and entering into the trajectory correction device 140 are acted upon by a force from the electric field or magnetic field generated in the trajectory correction device 140, whereby the travel direction of the droplets 101*a* is corrected so as to travel towards the EUV generation point 103. The trajectory correction device 140 thus corrects the trajectory of target material so as to converge to the EUV generation point 103, even if the ejection method in the droplet generation device 110 is unstable. In particular, the trajectory of the droplets 101*a* is corrected to a trajectory traveling towards the EUV generation point 103, in response to the electric field or magnetic field formed in the trajectory correction device 140, even in case of instantaneous changes in the ejection direction from the droplet generation device 110. The target material is thereby supplied stably to the EUV generation point 103, thus enabling the extreme ultraviolet light source device 1 according to the present embodiment to generate EUV light in a stable manner. The detailed configuration of the trajectory correction device 140 will be explained below.

The laser beam L1 emitted by the laser light source 150 is focused by the lens 152 and is irradiated onto the EUV generation point 103 in the EUV chamber 100 at a predetermined repetition operation frequency (for instance, 10 kHz). When the charged droplets 101*a* passing through the EUV generation point 103 are irradiated upon by the focused laser beam L1, the target material is turned into plasma and radiates EUV light. The EUV light thus generated is then led to an exposure device or the like by way of, for instance, a reflective optical system having a Mo/Si film formed thereon.

An explanation follows next on the configuration of electrodes provided in the trajectory correction device 140, as an embodiment where the above-described trajectory correction device 140 generates an electric field.

The electrode configuration in the trajectory correction device 140 may include a single electrode configuration employing a single electrode, or a block electrode configuration in which a plurality of electrodes are made into a block. The block electrode configuration may be a one-block configuration using only one electrode block, or a multiple-block configuration using a plurality of electrode blocks. Examples of such electrode configurations are explained in turn below.

Figure 2B:
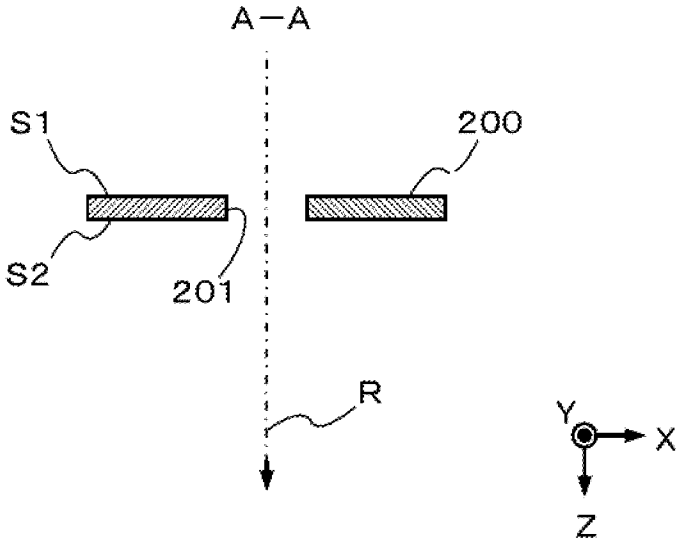
FIG. 2 illustrates a first embodiment of an electrode in a trajectory correction device 140.
Figure 2A:
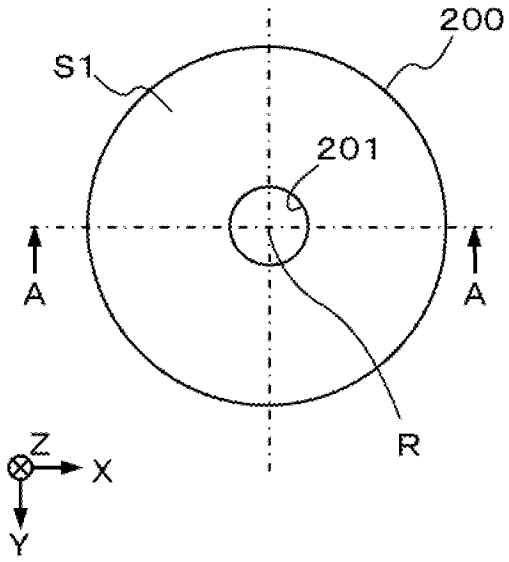

FIG. 2 illustrates a first embodiment of an electrode comprised in the trajectory correction device 140. The electrode according to the embodiment has a single circular hole electrode 200. That is, the present embodiment is an example of a single electrode configuration. FIG. 2A is a plan-view diagram of the circular hole electrode 200, and FIG. 28 is a cross-sectional diagram of the circular hole electrode 200 along A-A. The circular hole electrode 200 is a plate-like electrode having a circular hole 201 positioned substantially in the center of a the electrode's circular form. The circular hole electrode 200 is perpendicular to an ideal trajectory R, and is disposed in such a manner that the center of the circular hole 201 coincides with the ideal trajectory R of the droplets 101*a*. Alternatively, a tubular electrode may be another example of a single-electrode configuration. In the case of a tubular electrode, as well, the electrode is disposed in such a manner that the center axis thereof coincides with the ideal trajectory R.

Figure 3:
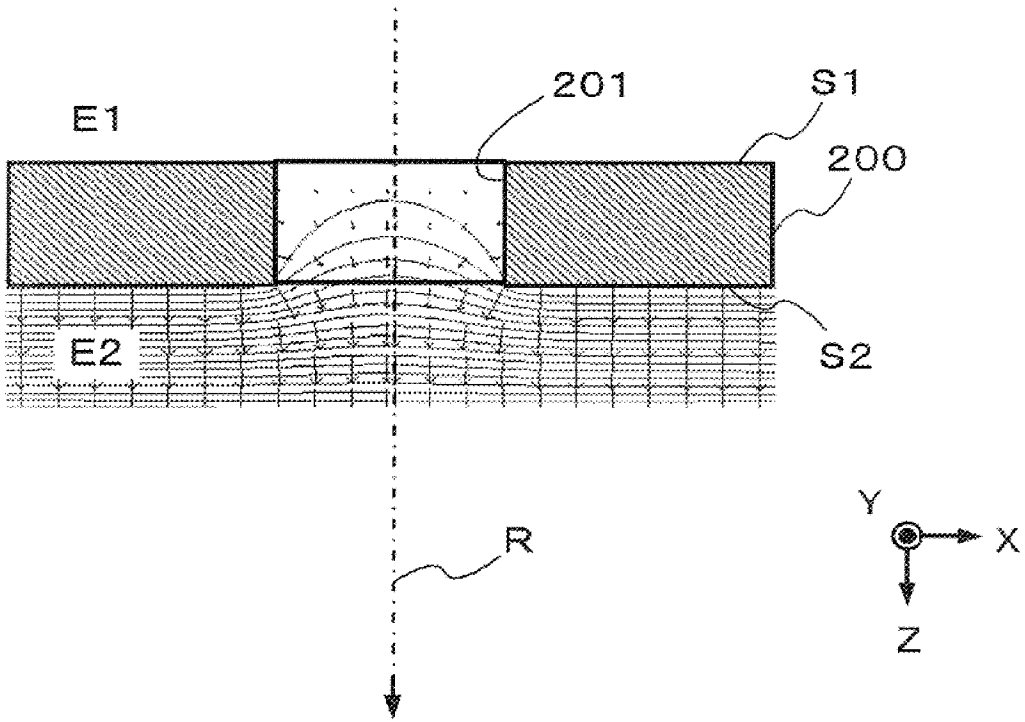
FIG. 3 illustrates an equipotential surface distribution in the vicinity of a circular hole of a circular hole electrode 200.

FIG. 3 illustrates a distribution of equipotential surfaces in the vicinity of the circular hole 201 when electric fields E1, E2 (E1<E2) of dissimilar intensities are formed on one face S1 and the other face S2 of the circular hole electrode 200 of FIG. 2.

As illustrated in FIG. 3, the equipotential surfaces are distributed bulging from the side S2, where the electric field intensity is strong, towards the side S1, where the intensity is weak, in the portion of the circular hole 201. The equipotential surfaces bulging into the circular hole 201 form curved surfaces whose apexes lie along the ideal trajectory R. When charged particles, i.e., the droplets 101*a* (shown in FIG. 1), penetrate into the circular hole 201 (shown in FIG. 3), the trajectory of the droplets is modified so as to become perpendicular to the equipotential surfaces. As a result, the electric field thus generated acts as an electrostatic lens, whereby the trajectory of the droplets 101*a* is corrected to the ideal trajectory R, in the same way as a convex lens in an optical system.

FIG. 4 illustrates a second embodiment of an electrode comprised in the trajectory correction device 140.

Figure 4B:
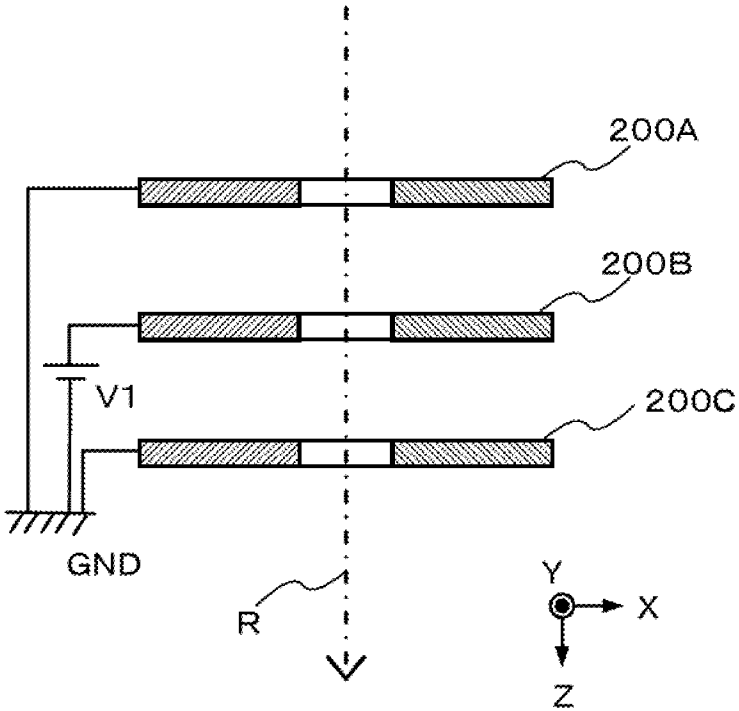
FIG. 4 illustrates a second embodiment of the electrode in the trajectory correction device 140.
Figure 4A:
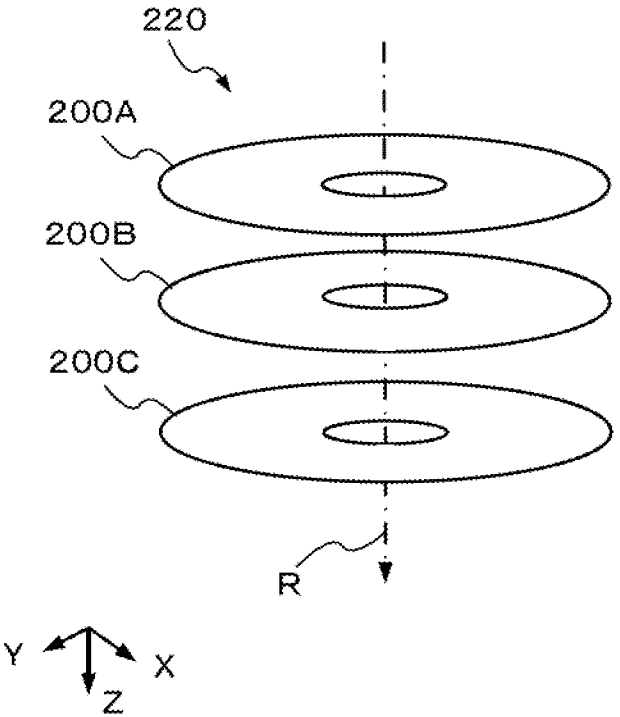

FIG. 4A is a perspective-view diagram of a block electrode 220 according to the present embodiment. As illustrated in FIG. 4A, the block electrode 220 according to the present embodiment is a one-block block electrode comprising three circular hole electrodes 200A to 200C. The block electrode 220 comprises three coaxial circular hole electrodes 200A to 200C, disposed equidistantly parallel to each other. The center axis of the three circular hole electrodes 200A to 200C is disposed so as to coincide with the ideal trajectory R of the droplets 101*a*.

FIG. 4B is a cross-sectional diagram of the block electrode 220 taken along an X-Z plane that contains the ideal trajectory R. Herein, a circular hole electrode 200A (incidence side) and a circular hole electrode 200C (exit side) are kept at the same potential (for instance, ground potential), while a positive or negative potential is applied to the circular hole electrode 200B disposed in the middle, whereby the block electrode 220 forms a so-called einzel lens (a unipotential lens), as recognized by those skilled in the art. As a result, the electric field generated by the block electrode 220 acts on the charged droplets 101*a* (shown in FIG. 1) as an electrostatic lens, thus functioning similarly to a convex lens. The block electrode 220 can exert a focusing force in the X and Y dimensions without accelerating or decelerating the droplets 101*a* in the Z direction.

By using such an einzel lens, the trajectory correction device 140 allows droplets to be reliably guided to a predetermined EUV generation point 103, without using a measuring device for measuring droplet position, or a control mechanism and a controller, or the like, for moving the droplet generation device, as is the case in conventional, or prior art. In particular, the trajectory correction device 140 can appropriately correct droplet trajectory even if the droplet ejection direction from the droplet generation device 110 is disturbed suddenly. As a result there can be provided an extreme ultraviolet light source device 1 that affords highly stable EUV output.

Figure 5B:
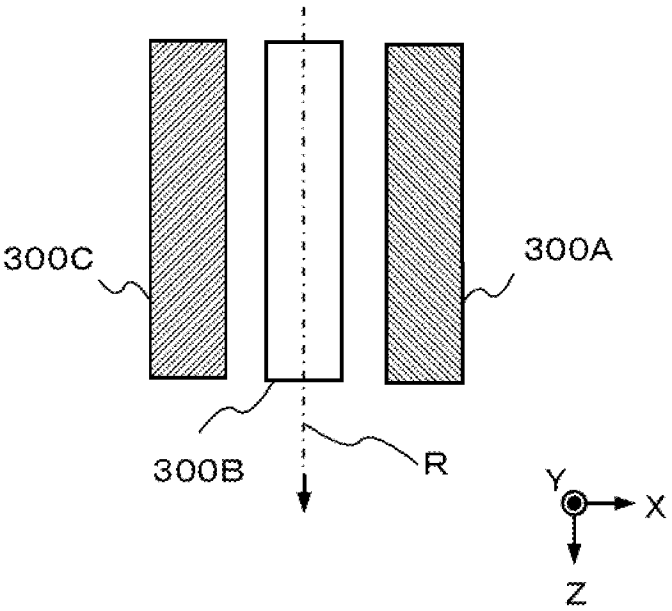
FIG. 5 illustrates a third embodiment of the electrode in the trajectory correction device 140.
Figure 5A:
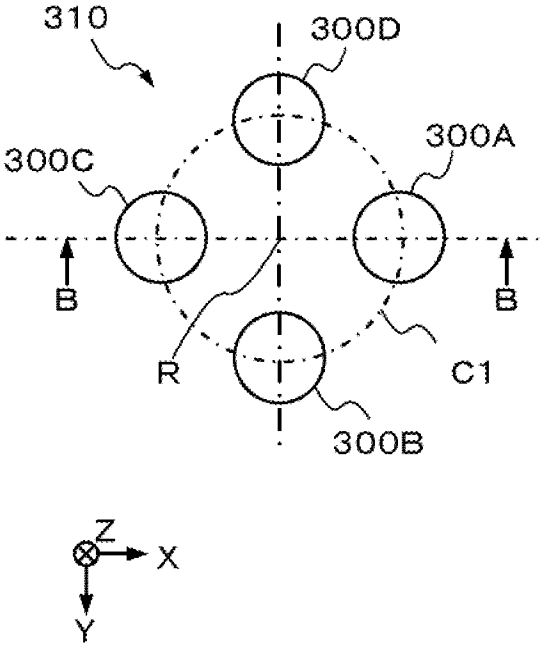

FIG. 5 illustrates a third embodiment of an electrode employed in the trajectory correction device 140. The electrode in the present embodiment is a block electrode 310 comprising a quadrupole electrode of four cylindrical electrodes 300A to 300D. FIG. 5A is a plan-view diagram of the block electrode 310, and FIG. 5B is cross-sectional diagram of the block electrode 310 taken along B-B. The cylindrical electrodes 300A to 300D are parallel to each other, and are disposed equidistantly on a circle C1 having a predetermined radius, in such a manner that the center of the circle C1 coincides with the ideal trajectory R of the droplets 101*a* (shown in FIG. 1). The block electrode 310 of the present embodiment is a quadrupole electrode having four cylindrical electrodes, but may also be a multipole electrode having more than four cylindrical electrodes.

By adjusting the length of the cylindrical electrodes in the Z-axis direction (cylinder height), a stronger force can be exerted in a multipole electrode configuration having a quadrupole electrode. A multipole configuration is therefore effective for very heavy particles, as is the case when the droplets 101 include molten metal.

Figure 6:
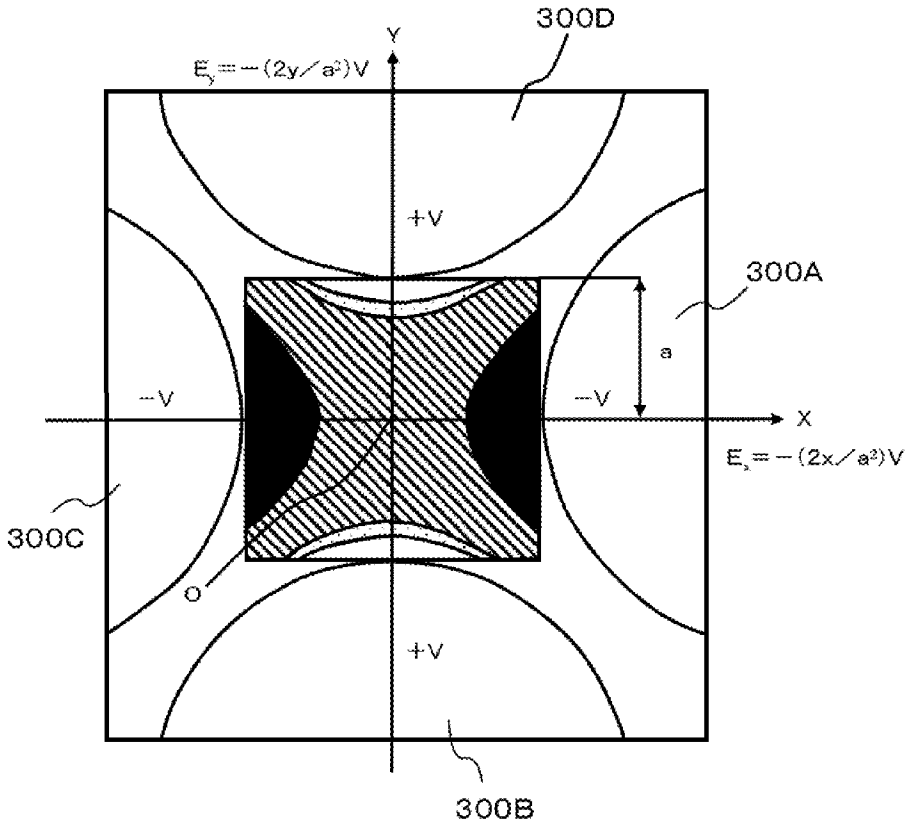
FIG. 6 illustrates potentials and potential distributions in a block electrode 310.

FIG. 6 illustrates the potential of the electrodes 300A to 300D of the block electrode 310 of FIG. 5, in the X-Y plane, and the potential distribution generated by the electrodes 300A to 300D. In the example of FIG. 6, the same potential (V) is applied to a pair of electrodes 300A and 300C, and an equipotential (−V) of inverse polarity is applied to another pair of electrodes 300B and 300D, the electrodes in each pair being axially symmetrical with respect to each other. A distance "a" from the origin O(X,Y)=(0,0) to each electrode A to D in FIG. 6, the electric field $E_x$ in the X-axis direction, and the electric field $E_y$ in the Y-axis direction are related as per equations (1) and (2) below.

$$E_x=-(2X/a^2)V \tag{1}$$

$$E_y=-(2Y/a^2)V \tag{2}$$

In the potential distribution within the space surrounded by the four electrodes 300A to 300D, the potential at the origin "O" is 0. The potential in the X-axis direction drops as the distance from the origin "O" increases, whereas the potential in the Y-axis direction rises as the distance from the origin "O" increases. When positively charged droplets 101*a* enter into this electric field, a focusing force acts to urge the droplets towards Y=0 in the Y-axis direction, and a defocusing force urging the droplets towards a greater absolute value of X in the X-axis direction. The magnitudes of the focusing force and the defocusing force are equal here. In the case of negatively charged droplets 101*a*, conversely, the focusing force acts in the X-axis direction and the defocusing force acts in the Y-axis direction.

In the quadrupole electrode configuration, a focusing force thus acts in either the X-axis or the Y-axis direction, while a defocusing force acts on the other direction. Therefore, a multiple-block configuration in which two or more block electrodes are disposed in the Z-axis direction is required in order to focus, to the EUV generation point 103, those droplets 101*a* that enter into the electric field generated by the block electrode 310 with some variation in the X-axis direction and the Y-axis direction.

As a whole, the block electrodes in a multiple-block configuration exert a force on charged droplets (charged particles) in such a way, so as to focus the travel direction of the droplets to one point, in a manner equivalent to the action exerted by a lens on a beam of light. For this reason the electrodes in a multiple-block configuration are also called an electrostatic lens. In a configuration having a plurality of block electrode groups, each electrode functions as a respective lens in the X-axis direction or the Y-axis direction, such that, as a result, the entire apparatus functions in a similar way as an optical system for focusing a light beam.

Figure 7B:
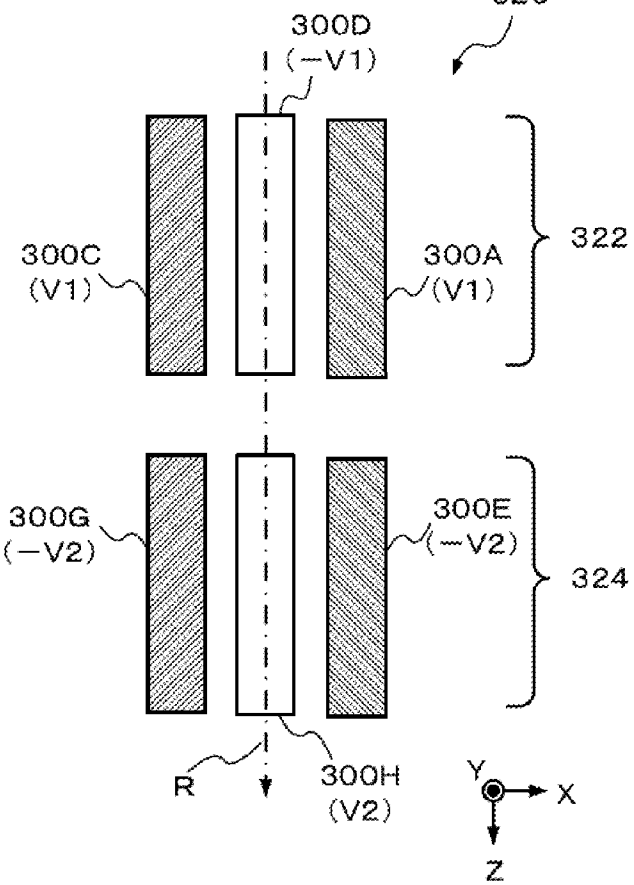
FIG. 7 illustrates a fourth embodiment of the electrode in the trajectory correction device 140.
Figure 7A:
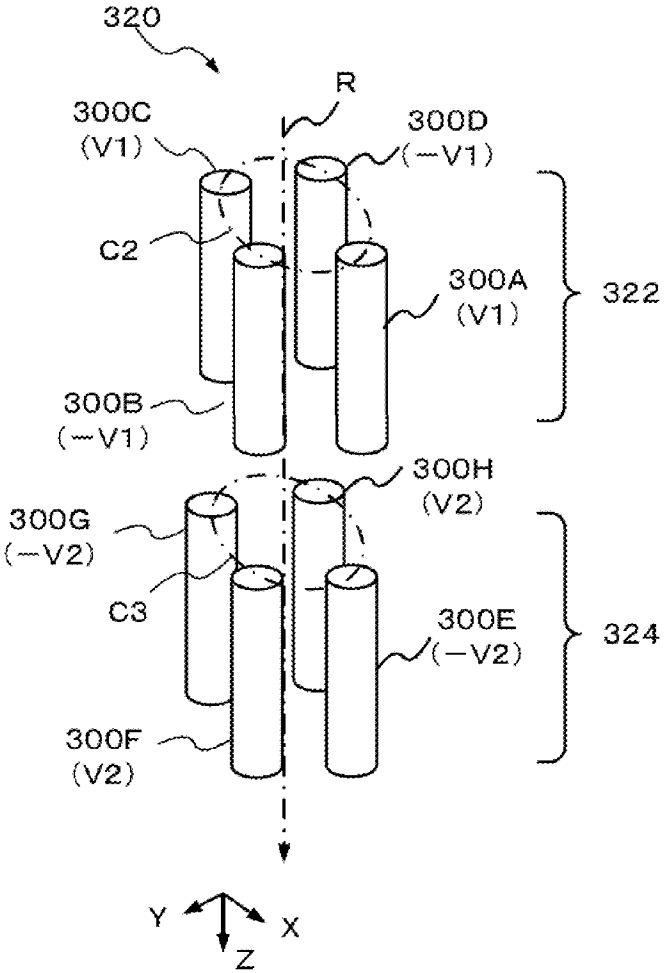

FIG. 7 illustrates a fourth embodiment of an electrode included in the trajectory correction device 140. FIG. 7A is a perspective-view diagram of a block electrode 320 having a doublet configuration in which two quadrupole electrodes are juxtaposed along the Z-axis. FIG. 7B is a cross-sectional diagram of the block electrode 320 in the X-Z plane that contains the ideal trajectory R. The block electrode 320 includes a first-stage quadrupole electrode 322 having cylindrical electrodes 300A to 300D, and a second-stage quadrupole electrode 324 having cylindrical electrodes 300E to 300H. As in the one-block configuration of FIG. 5, the cylindrical electrodes 300A to 300D in the quadrupole electrode 322 are parallel to each other and are disposed equidistantly on a circle C2 (shown in FIG. 7A) of a predetermined radius. The cylindrical electrodes 300E to 300H of the quadrupole electrode 324 are parallel to each other and are disposed equidistantly on a circle C3 having the same radius as C2. The centers of the circles C2 and C3 of the quadrupole electrode 322 and the quadrupole electrode 324 coincide with the ideal trajectory R. The quadrupole electrode 322 and the quadrupole electrode 324 are disposed from each other in parallel along the Z-axis. In the example of FIG. 7, the cylindrical electrodes 300A and 300C and the cylindrical electrodes 300E and 300G are disposed on the X-axis, whereas the cylindrical electrodes 300B and 300D and the cylindrical electrodes 300F and 300H are disposed on the Y-axis.

In the block electrode 320 having the cylindrical electrodes 300A to 300H arranged as described above, the potential pattern applied to the quadrupole electrode 322 and the potential pattern applied to the quadrupole electrode 324 are rotated by 90 degrees with respect to each other. In the quadrupole electrode 322, specifically, a positive potential (V1) is applied to the cylindrical electrodes 300A and 300C disposed on the X-axis, while a negative potential (−V1) is applied to the cylindrical electrodes 300B and 300D disposed on the Y-axis. In the quadrupole electrode 324, a negative potential (−V2) is applied to the cylindrical electrodes 300E and 300G disposed on the X-axis, while a positive potential (V2) is applied to the cylindrical electrodes 300F and 300H disposed on the Y-axis. The absolute values of the potentials applied to the quadrupole electrode 322 and the quadrupole electrode 324 (i.e., the values of V1 and V2) may be identical, or different.

The potential distribution around the quadrupole electrode 324 is similar to that illustrated in FIG. 6. That is, droplets positively charged are focused in the X-axis direction and defocused in the Y-axis direction. The potential distribution around the quadrupole electrode 322 is similar to that illustrated in FIG. 6 but rotated by 90 degrees. Accordingly, droplets positively charged are defocused in the X-axis direction, and focused in the Y-axis direction.

Figure 8:
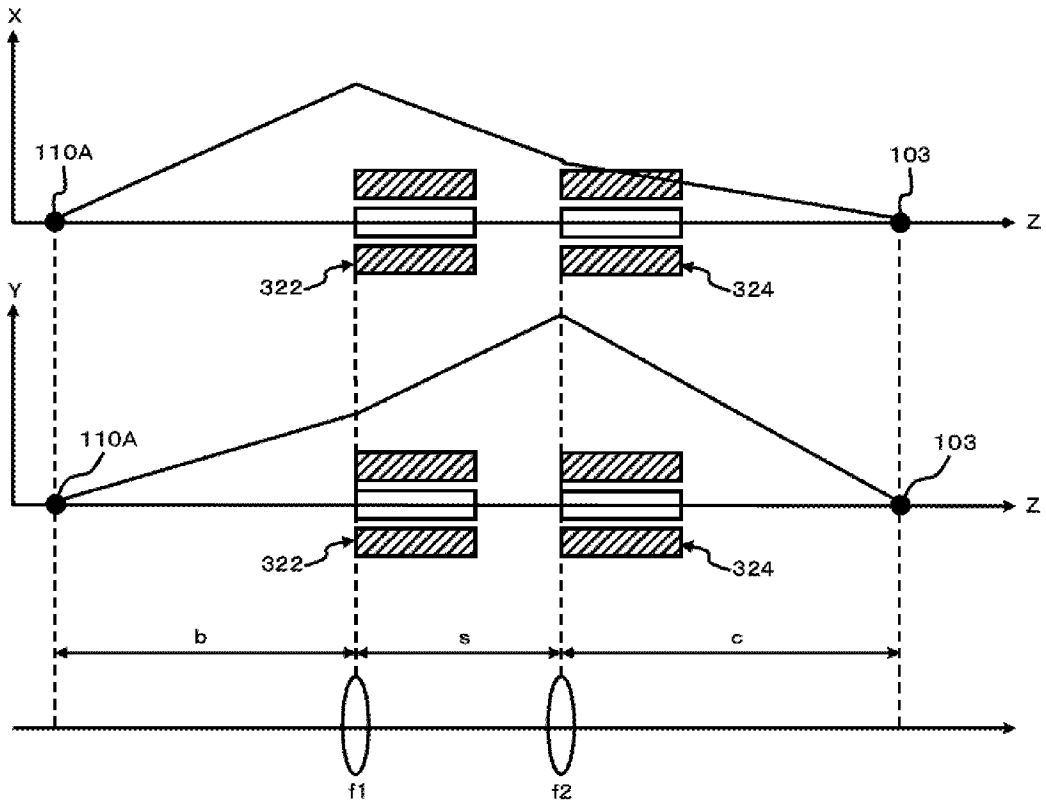
FIG. 8 illustrates trajectories of droplets 101*a* when using a block electrode 320 having a doublet-configuration.

FIG. 8 illustrates a trajectory of droplets 101*a*, from a droplet generation point (nozzle position in the droplet generation device 110, shown in FIG. 1) on through the first-stage quadrupole electrode 322 and the second-stage quadrupole electrode 324 of the block electrode 320, when using the block electrode 320 with the above-described doublet configuration in the trajectory correction device 140 (the charging device 130 and deflection device 135 are omitted). The focusing conditions for focusing droplets 101*a* to the EUV generation point 103 are determined on the basis of FIG. 8. The upper portion of FIG. 8 illustrates the trajectory in the X-Z plane, and the lower portion of the figure illustrates the trajectory in the Y-Z plane.

As illustrated in FIG. 8, "b" denotes the distance, along the ideal trajectory, from a predetermined reference point 110A, upstream from the trajectory correction device 140 or from the field generated by the trajectory correction device 140, up to the first-stage quadrupole electrode 322 of the block electrode 320; "s" denotes a distance from the quadrupole electrode 322 to the second-stage quadrupole electrode 324; "c" denotes a distance from the quadrupole electrode 324 to the EUV generation point 103; and "L" denotes the length of the quadrupole electrodes 322, 324 in the Z-axis direction (cylinder height). Taking as f1 and f2 the respective effective focal lengths of the quadrupole electrodes 322 and 324 functioning as electrostatic lenses, the combined focal length F (focal length of the block electrode 320) of the two electrostatic lenses is given by the simple equation below using a thin-lens approximation. The reference point 110A may be any point on the ideal trajectory between the trajectory correction device 140 and the charging device 130. The reference point 110A may be the point at which the droplets 101*a* are outputted from the charging device 130, or the point at which the droplets 101*a* are outputted from the deflection device 135.

$$1/F=1/f1+1/f2-s/(f1\times f2) \quad (3)$$

Thus, the block electrode 320 constitutes an optical system such that droplets are focused to the EUV generation point 103, based on the combined focal length F of the block electrode 320 as given by equation (3). Herein, the electrostatic lenses of the two quadrupole electrodes 322 and 324 have the same focal lengths, of opposite sign (f=f1=−f2) in the X-Z plane (Y=0) and in the Y-Z plane (X=0). When, for example, the initial speed of Sn droplets along the Z-axis is 20 m/s, the particle size of the droplets is 30 μm and the charge of the droplets is 2 pC, the relationship given by equation (1) yields an effective focal length f=50 mm of the electrostatic lens of each quadrupole electrode 322, and 324, for V=500 V, b=5 mm and L=10 mm, and the focusing conditions of b=c=150 mm are satisfied when s=37.5 mm.

Figure 9A:
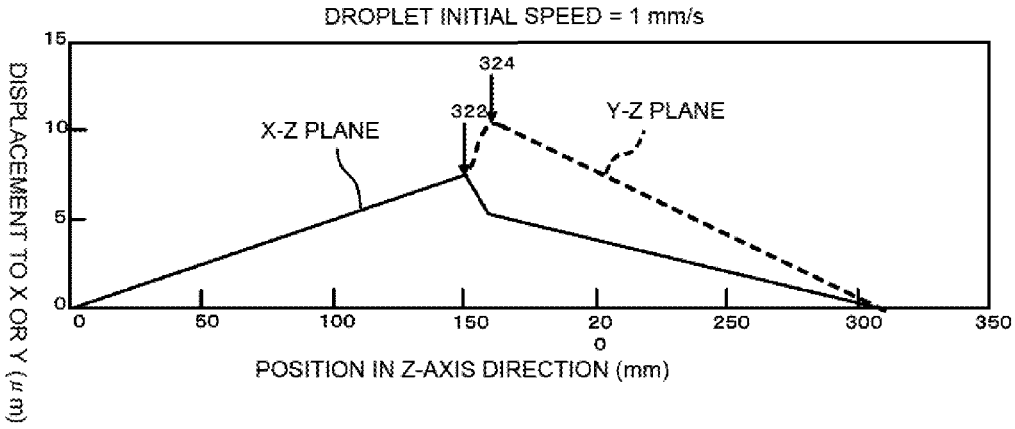
FIG. 9 illustrates simulation results of trajectories of droplets 101*a* when the doublet-configuration block electrode 320 satisfies focusing conditions.
Figure 9B:
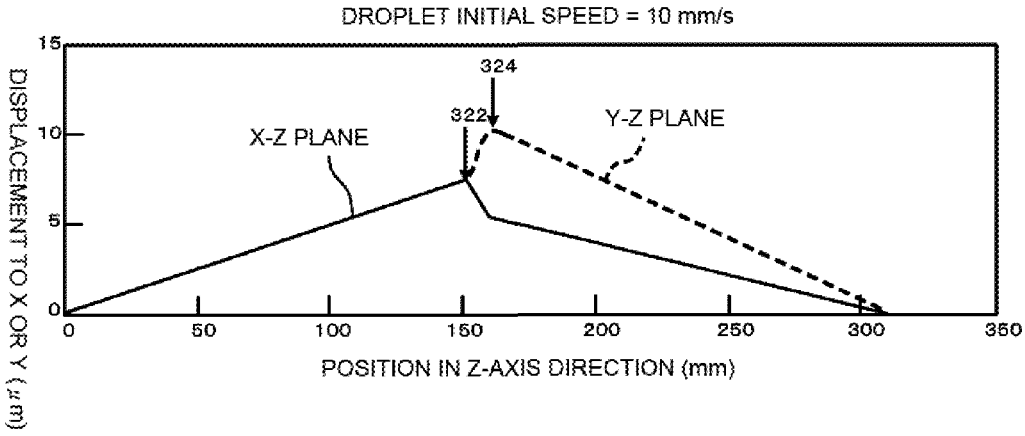

FIG. 9 illustrates results of a simulation of the trajectory of droplets 101*a* having a given initial speed in a direction perpendicular to the Z-axis (direction in the X-Y plane) in the block electrode 320 conforming to the above conditions. FIG. 9A gives the results of a simulation with an initial speed of 1 mm/s in a direction perpendicular to the Z axis, and FIG. 9B gives the results of a simulation with an initial speed of 10 mm/s in a direction perpendicular to the Z-axis. FIGS. 9A and 9B show that the droplet trajectory focuses at a position c=150 mm, independently from the initial speed in the direction perpendicular to the Z-axis.

As described above, employing a doublet configuration of quadrupole electrodes in the trajectory correction device 140 allows droplets to be reliably guided to a predetermined EUV generation point 103, without using a measuring device for measuring droplet position, or a control mechanism and a controller, or the like, for moving the droplet generation device, as is the case in conventional, or prior art. As a result, there can be provided an extreme ultraviolet light source device 1 that affords highly stable EUV output.

As illustrated in FIGS. 8 and 9, the distance "b" between the droplet generation point 110A and the quadrupole electrode 322 is identical to the distance "c" from the quadrupole electrode 324 to the focusing position. In a doublet configuration, therefore, the distance "c" is uniquely determined through setting of the distance "b". In other words, the distance "c" cannot be arbitrarily set in a block electrode having a doublet configuration.

Figure 10:
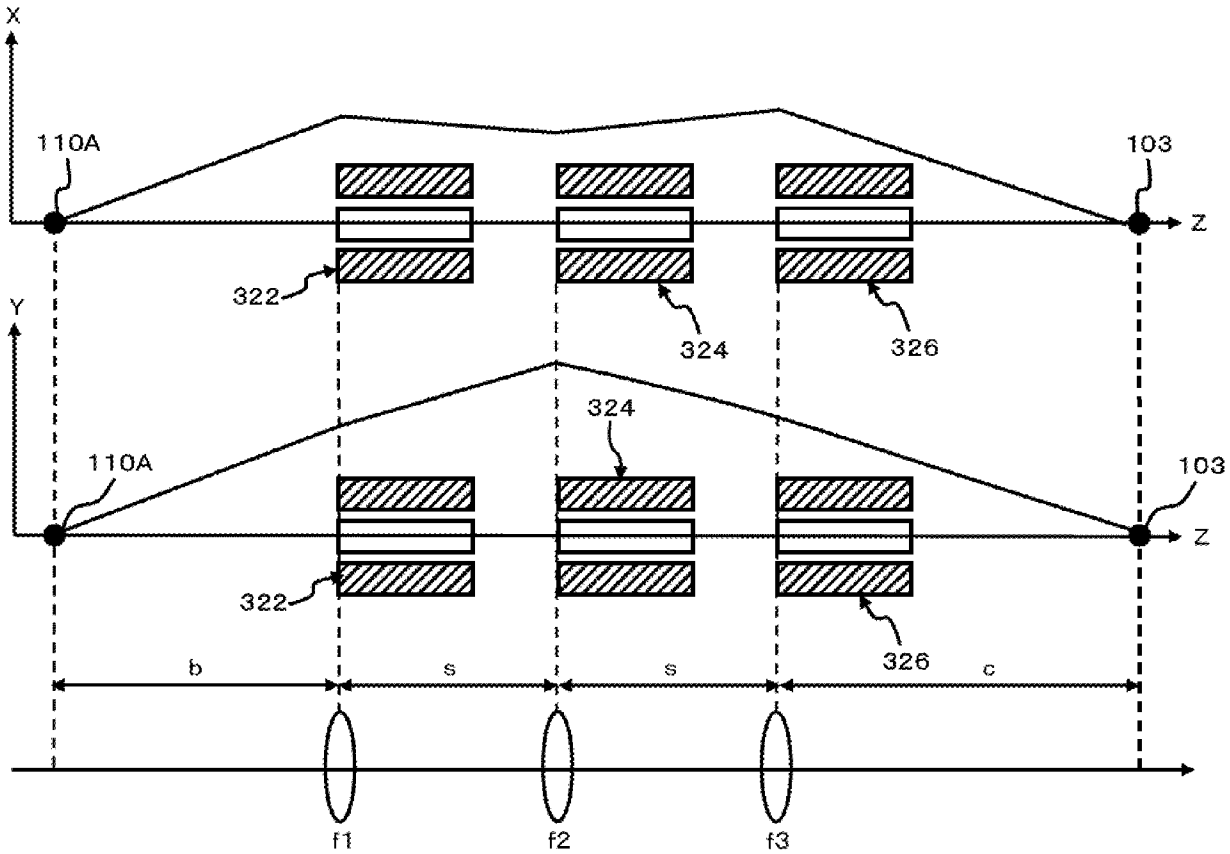
FIG. 10 illustrates trajectories of droplets 101*a* when using a triplet-configuration block electrode 330 in the trajectory correction device 140.
Figure 11A:
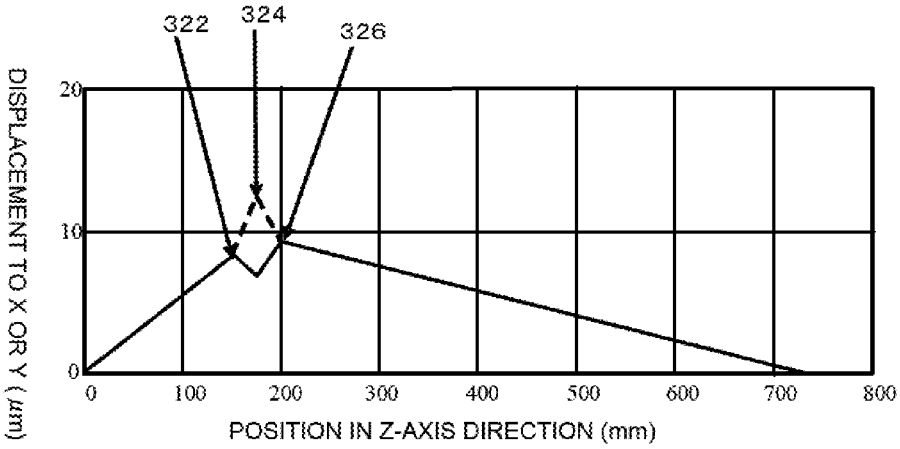
FIG. 11 illustrates simulation results of trajectories of droplets 101 a when the triplet-configuration block electrode 330 satisfies focusing conditions.
Figure 11B:
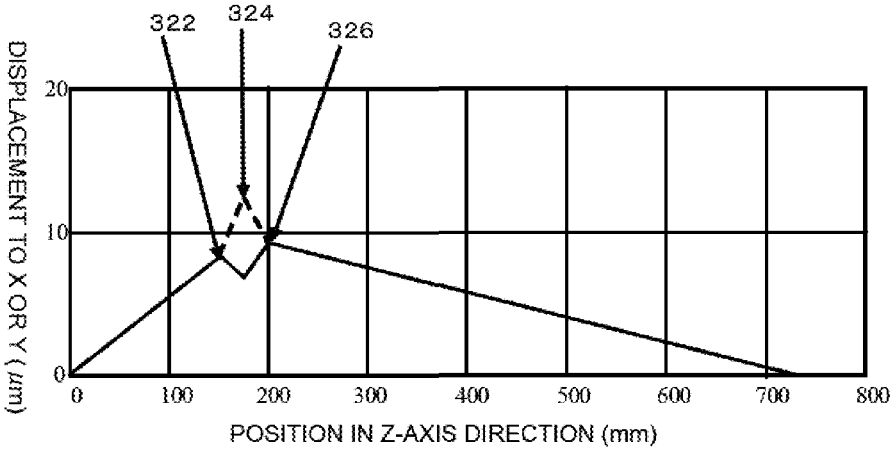

By contrast, the distance "c" from the quadrupole electrode at a last stage of a block electrode up to the EUV generation point 103 can be arbitrarily set when using a block electrode having a triplet configuration in which three quadrupole electrodes are juxtaposed along the Z-axis. FIG. 10 illustrates a schematic diagram of a block electrode 330 having a triplet configuration, and FIG. 11 illustrates simulation results of a trajectory calculation in the case of the block electrode 330 having a triplet configuration.

Herein, the distance from a quadrupole electrode 322 to a quadrupole electrode 324, and the distance from the quadrupole electrode 324 to a quadrupole electrode 326 are the same distance "s", and the distance "b" from the droplet generation point 110A to the quadrupole electrode 322 is b=150 mm. The electrostatic lenses of the three quadrupole electrodes 322, 324, and 326 have the same focal length (f=f1=−f2=f3) of opposite sign at the X-Z plane (Y=0) and the Y-Z plane (X=0), respectively. When, for example, the initial speed of Sn droplets along the Z-axis direction is 18 m/s, the particle size of the droplets is 30 μm and the charge of the droplets is 2 pC, the relationship given by equation (1) yields a focusing point at a distance c=725 mm from the quadrupole electrode 326 for V=330 V, b=5 mm and L=10 mm, irrespective of the initial speed in a direction perpendicular to the Z-axis, as illustrated in FIG. 11. Whereas the distance "b" from the droplet generation point 110A to the focusing point (EUV generation point 103) of the droplet trajectories cannot be modified in the doublet configuration of FIG. 7, in the triplet configuration of the present embodiment the distance "c" from the triplet electrode 330 to the droplet trajectory focusing point (EUV generation point 103, EUV emission point) can be set at an arbitrary position by optimizing electrode potential, irrespective of the distance "b" from the droplet generation point 110A to the triplet electrode 330. This affords, as a result, easier combination with other structural components (for instance, large concave mirrors for EUV focusing) of the EUV generation device, as well as a wider range of conditions under which the EUV light source can operate.

In the embodiments explained thus far, charged droplets are focused through the formation of an electric field, but the charged droplets can also be focused by way of a magnetic field. That is, the trajectory correction device 140 may comprise magnets that generate a magnetic field.

Figure 12B:
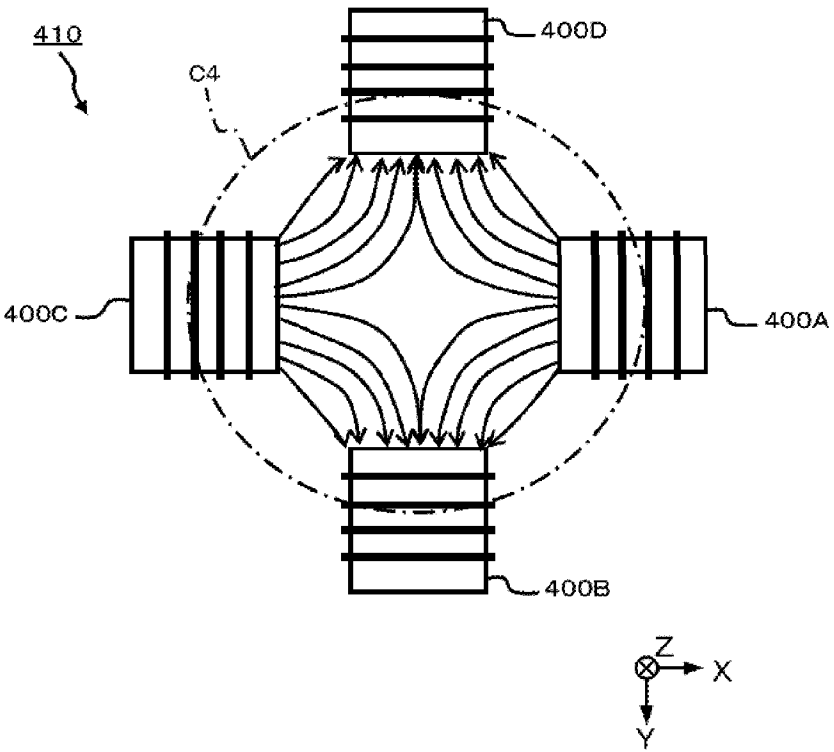
FIG. 12 illustrates an example of a magnet block configuration that can be used in the trajectory correction device 140.
Figure 12A:
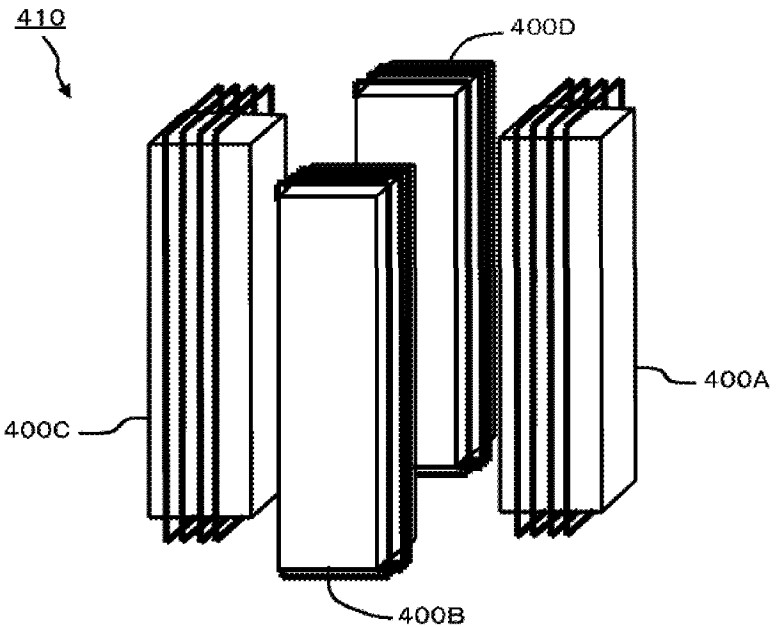

FIG. 12 illustrates an example of a configuration of magnet blocks that can be appropriately used in the trajectory correction device 140 in an embodiment where the trajectory correction device 140 generates a magnetic field. In the present embodiment, a plurality of magnets make up a magnet block 410. FIG. 12A is a perspective-view diagram of the magnet block 410, where four parallelepiped magnets 400A to 400D of identical shape form a magnet block 410. FIG. 12B is a plan-view diagram of the magnet block 410. The magnets 400A to 400D may be permanent magnets or electromagnets.

The magnets 400A to 400D are disposed equidistantly from each other on the circumference of a circle C4 having a given radius. The magnets 400A to 400D are arranged parallel to each other in such a manner that a side face of each magnet (inward face) opposes the center of the circle C4. That is, the inward faces of each pair of opposing magnets 400A and 400C, and 400B and 400D face each other, and are substantially parallel to one another. The magnets are disposed in such a manner that the center of the circle C4 coincides with the ideal trajectory R.

The magnets are also disposed in such a manner that opposing faces of opposing magnets 400A and 400C, and 400B and 400D have the same polarity, and in such a manner that the polarity of the inward face of a given magnet 400 is inverse to the polarity of the inward faces of the two magnets adjacent thereto. In the case of FIG. 12, for instance, the opposing faces of the magnets 400A and 400C are N-poles, whereas the opposing faces of the magnets 400B and 400D are S-poles. As a result, magnetic field lines are distributed so as to issue from the magnets 400A and 400C, and enter into the magnets 400B and 400D, as illustrated in FIG. 12B.

Charged droplets 101*a* entering into the magnetic field generated by the magnet block 410 are acted upon by Lorentz forces, whereby the trajectory of the droplets 101*a* is deflected. Although the directions of the Lorentz forces differ from those of the above-described quadrupole electrode, in that they are oblique to the X-axis and the Y-axis by 45 degrees, the magnet block 410 has the same basic configuration for focusing droplets 101*a* to the EUV generation point 103. Accordingly, magnet blocks can be used instead of electrodes. That is, the formed magnetic field functions as a magnetic lens that corrects the trajectory of the droplets 101*a*.

Figure 13:
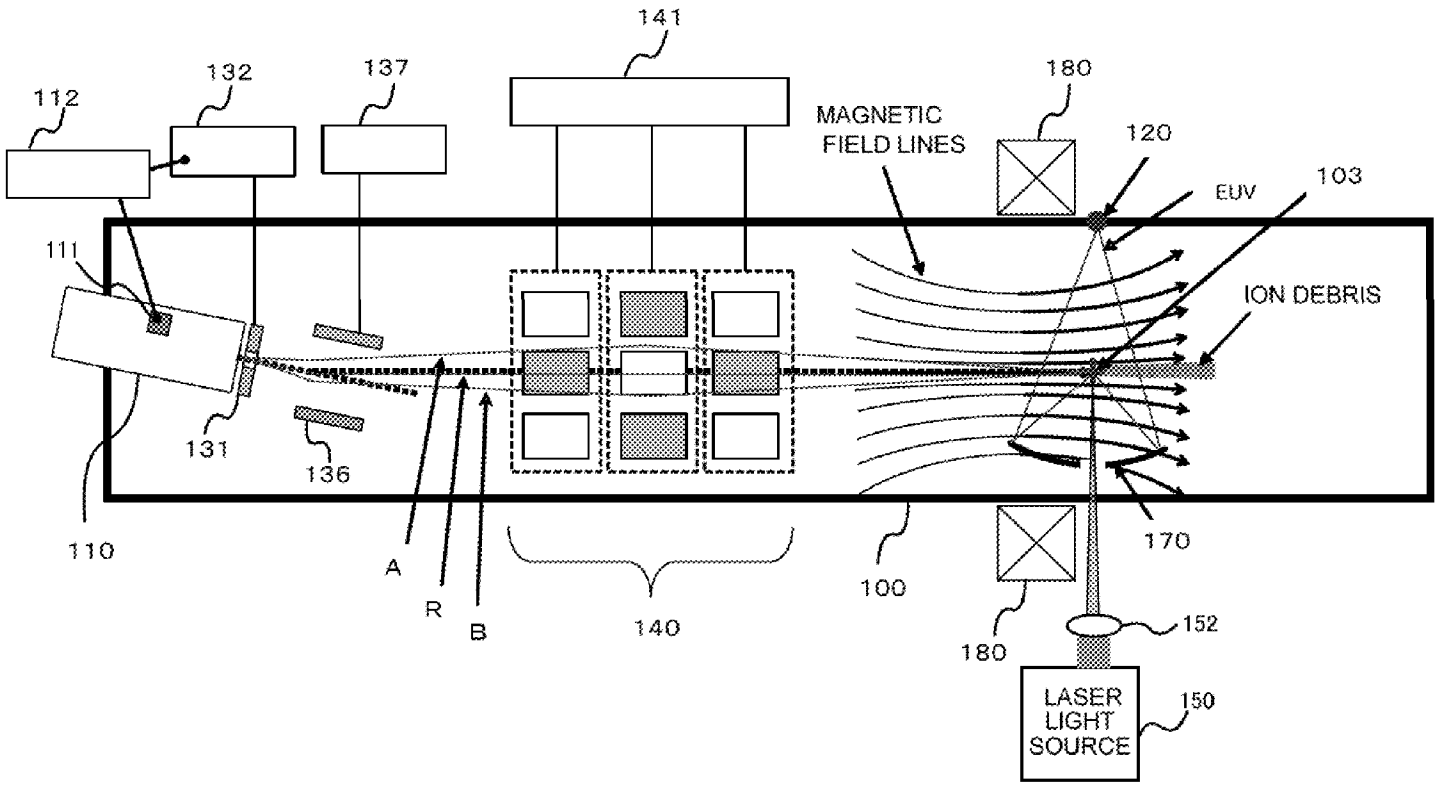
FIG. 13 illustrates another embodiment of the extreme ultraviolet light source device 1.

FIG. 13 illustrates another embodiment of the extreme ultraviolet light source device 1. FIG. 13 is a schematic cross-sectional diagram of the extreme ultraviolet light source device 1. The extreme ultraviolet light source device 1 according to FIG. 13 includes evacuated EUV chamber 100; droplet generation device 110 that generates droplets; charging device 130 that selectively charges droplets 101 generated by the droplet generation device 110 by imparting charge to the droplets; deflection device 135 that deflects the droplets 101*a* charged by the charging device 130 and removes the droplets 101*a* from the trajectory of uncharged droplets 101*b;* trajectory correction device 140 that corrects the trajectory of the charged droplets 101*a;* laser light source 150 and lens 152 (all described previously with respect to FIG. 1); and an EUV collector mirror 170 for focusing radiated EUV light to an EUV focal point 120 and a ring-shaped debris shield magnet 180 provided along the outer periphery of the EUV chamber 100.

The droplet generation device 110 includes, for instance, an oscillator (piezoelectric element) 111 for generating uniform droplets from a liquid jet discharged from a nozzle through continuous jetting; and an oscillator controller 112 that causes the oscillator to oscillate at a given frequency.

The charging device 130 includes a charging electrode 131 and a charging controller 132. The deflection device 135 includes a deflecting electrode 136 and a deflecting electrode controller 137.

The deflection device 135 deflects droplets charged by the charging device 130, from among the droplets ejected by the droplet generation device 110, and supplies the droplets to the EUV generation point 103. Given that the droplets are deflected by the deflection device 135, the ejection direction of the droplets 101 from the droplet generation device 110 is slightly oblique with respect to an ideal trajectory R.

The trajectory correction device 140 uses herein a triplet structure of quadrupole electrodes. The trajectory correction device 140 further comprises a trajectory correction electrode controller 141 that controls the potential applied to the electrodes of the triplet structure.

The debris shield magnet 180 generates a magnetic field in the EUV chamber 100. Debris comprising ions formed at the time of EUV generation at the EUV generation point 103 is discharged, through the action of Lorentz forces from the above magnetic field, in a direction such that the debris does not adhere to the EUV collector mirror 170.

The EUV generation point 103 is set further downstream than the debris shield magnet 180 in the travel direction of the droplets (shown to the right of the magnet 180 in FIG. 13). The purpose of this is to cause the ion debris after laser irradiation to be discharged downstream in the travel direction of the droplets. In doing so, however, the charged droplets must traverse the magnetic field generated by the debris shield magnet 180 before reaching the EUV generation point 103. To minimize the influence of this magnetic field, the charged droplets are preferably incident parallel to the magnetic field lines, i.e., incident along the ideal trajectory R. Further, due to the configuration of the device, when charged droplets are incident at an angle with respect to magnetic field lines (at a right angle, in the extreme case), it becomes necessary to determine the incidence position by assessing in advance the amount by which the trajectory of the charged droplets varies on account of Lorentz forces arising from the magnetic field.

In an extreme ultraviolet light source device 1 having such a configuration, the trajectory correction device 140 corrects the trajectory of the charged droplets 101*a* to focus the latter to the EUV generation point 103, even when the ejection direction of the droplets from the droplet generation device 110 deviates from the ideal trajectory R, for instance as denoted by trajectory A or B in the FIG. 13. In the extreme ultraviolet light source device 1 of the present embodiment, as a result, the charged droplets 101*a* are unfailingly irradiated by a laser beam, so that EUV light can be outputted stably irrespective of the ejection direction from the droplet generation device 110.

Figure 14:
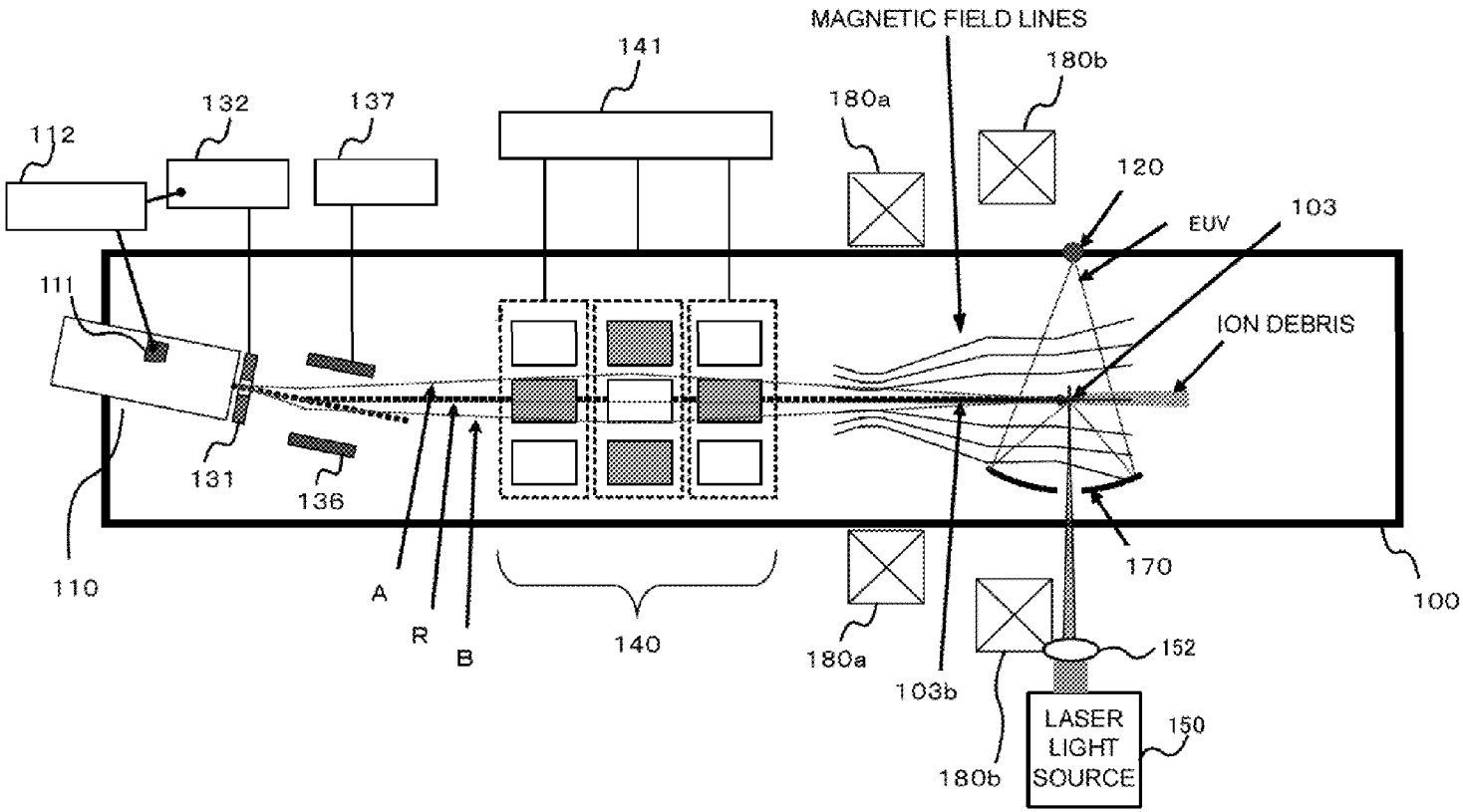
FIG. 14 illustrates yet another embodiment of the extreme ultraviolet light source device 1.
Figure 15:
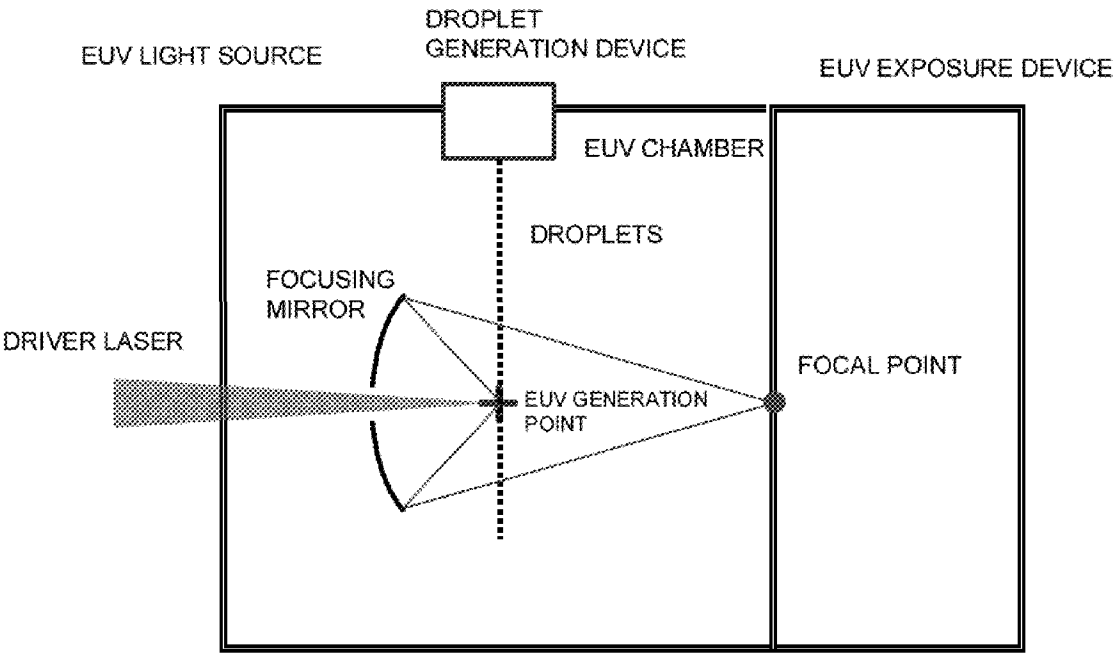
FIG. 15 illustrates a conventional EUV light source device that generates extreme ultraviolet light according to prior art.
Figure 16A:
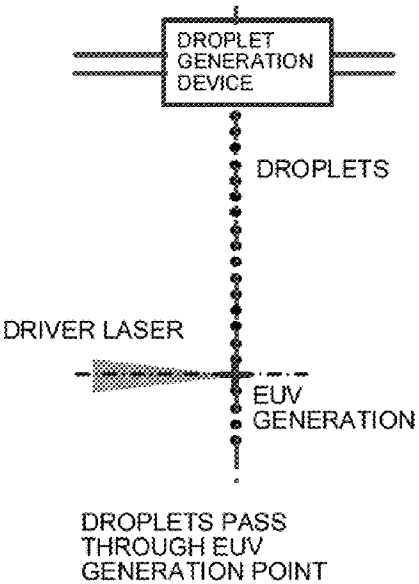
FIG. 16 illustrates an instance of droplet position correction according to prior art.
Figure 16B:
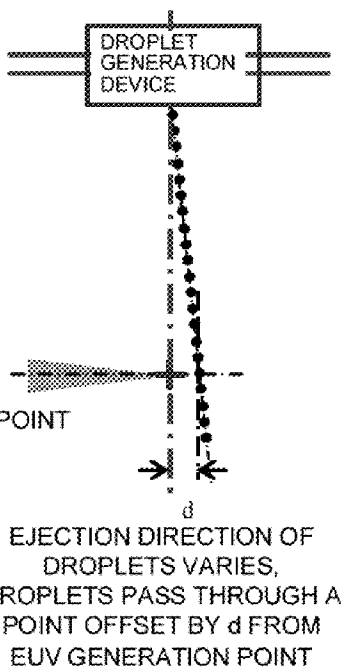
Figure 16C:
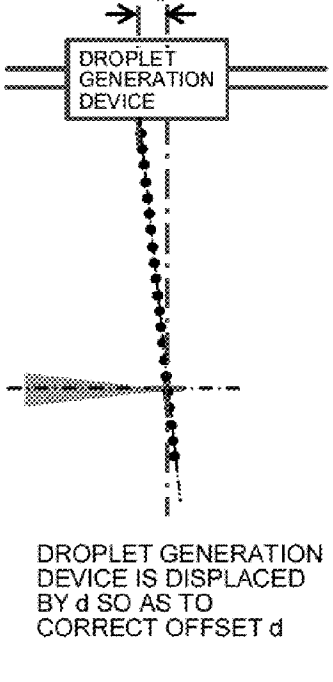
Figure 17A:
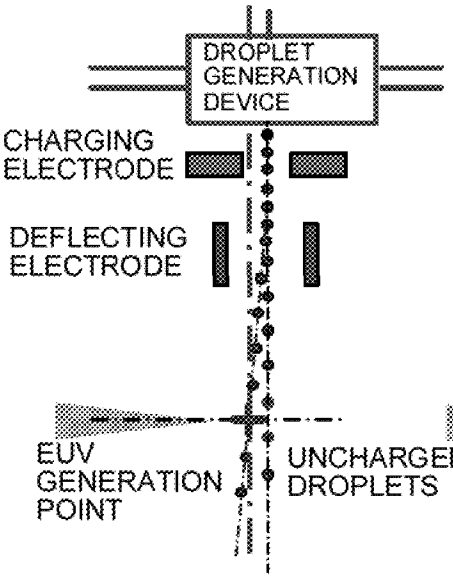
FIG. 17 illustrates an instance of droplet position correction according to prior art.
Figure 17B:
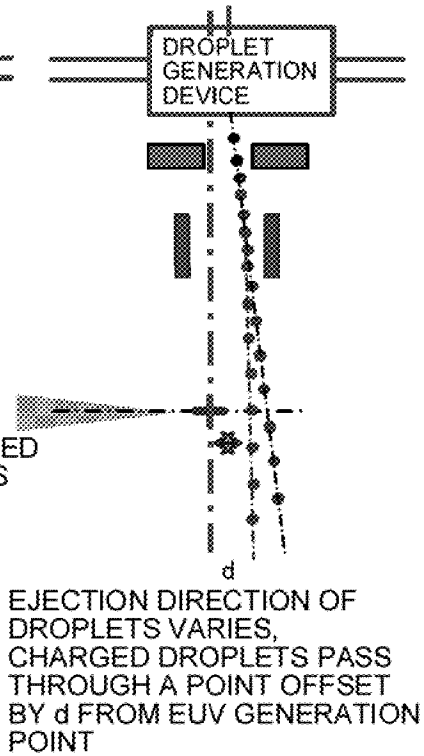
Figure 17C:
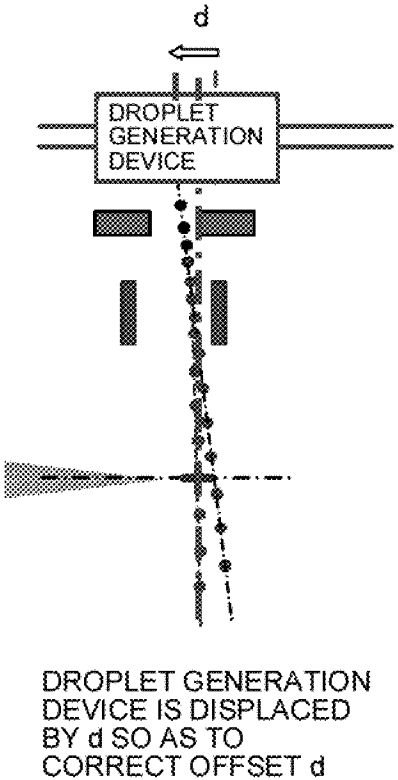

FIG. 14 illustrates another embodiment, as a modification of the extreme ultraviolet light source device 1 illustrated in FIG. 13. In the extreme ultraviolet light source device 1 of FIG. 14 there are provided two ring-shaped debris shield magnets 180 (180*a*, 180*b*) (double magnets). The diameter of the debris shield magnet 180*b* disposed downstream in the travel direction of the droplets is greater than the diameter of the upstream debris shield magnet 180*a*. As a result, the magnetic field lines formed in the EUV chamber 100 are widened in the debris discharge direction. Thereby, ion debris is discharged more readily than is the case in the example of FIG. 13. In the example of FIG. 14, the EUV generation point 103 is set downstream of the magnet 180*b*, but may also be set between the magnet 180*a* and the magnet 180*b*.

The above-described embodiments provide a droplet supply scheme, as a target supply method for EUV generation, in which any occurring fluctuations of the droplets in the ejection direction from a nozzle are corrected so that the droplets can be supplied to a point with precision, by introducing a trajectory correction device 140 using an electric field or a magnetic field, on the trajectory of droplets from a droplet generation device 110 to a laser focal point (EUV emission point) 103. As a result, EUV intensity variations among pulses, as well as fluctuations in the position and/or changes in the spatial distribution of the emission point, can be kept small, which affords high-quality EUV light emission/supply.

Also, droplets incident at different speeds in the radial direction can be focused in principle to a predetermined point by way of the trajectory correction device 140, by satisfying focusing conditions. This kind of passive control is not affected by control loop bandwidth, and hence is advantageous for pulse-driven high-repetition EUV equipment, as it is basically unconstrained by repetition frequency limitations.

Through changes in electrode potential, the trajectory correction device 140 enables flexible response to various conditions in accordance with droplet diameter, initial speed upon ejection from the nozzle, or desired focusing position. Propagation can be secured by appropriately arranging supplementary electrodes, without droplet position variation becoming exacerbated thereby, even when the distance between the droplet generation point 110A and the EUV generation point 103 must be lengthened for reasons of layout.

In the EUV light source where the trajectory correction device 140 is installed, droplets are made to pass ultimately through a point determined in advance (EUV generation point 103, being a laser irradiation point), by causing a charged droplet target to pass through an electrostatic electric field generated by an electrostatic lens or a quadrupole electrode lens, or through a static magnetic field created by a quadrupole magnet lens, even in case of changes in the ejection direction of the droplet target ejected from the nozzle. As a result, the laser can unfailingly strike the droplet target. This enables stable EUV output over long periods of time, and thus makes it possible to provide a highly-reliable EUV light source.

While the best modes for carrying out the invention have been described in detail, those familiar with the art to which this invention relates will recognize various alternative designs and embodiments for practicing the invention within the scope of the appended claims.

What is claimed is:

1. An extreme ultraviolet (EUV) light source device for irradiating a droplet at an emission point with externally supplied laser light to turn the droplet into plasma from which the EUV light is emitted, the EUV light source device comprising:

a droplet generation device configured to supply droplets;

a charge supply device configured to selectively charge the droplets to generate a charged droplet and an uncharged droplet;

a deflection device configured to deflect a trajectory of the charged droplet only toward the emission point; and a trajectory correction device including an electrostatic lens for correcting the trajectory of the deflected droplet so that the deflected droplet reaches the emission point;

wherein the droplet generation device is inclined with respect to a trajectory toward the emission point, so that the trajectories of droplets leaving the droplet generation device are inclined with respect to a trajectory toward the emission point.

2. The EUV light source device according to claim 1, further comprising a lens for focusing the externally supplied laser light on the emission point.

3. The EUV light source device according to claim 1, wherein the droplet generation device includes a piezoelectric element.

4. The EUV light source device according to claim 1, wherein the electrostatic lens having a doublet configuration including two quadrupole electrodes.

5. The EUV light source device according to claim 1, wherein the electrostatic lens having a triplet configuration including three quadrupole electrodes.

6. The EUV light source device according to claim 1, further comprising a debris shield magnet for discharging debris generated when the EUV light is generated.

7. An extreme ultraviolet (EUV) light source device for irradiating a droplet at an emission point with externally supplied laser light to turn the droplet into plasma from which the EUV light is emitted, the EUV light source device comprising:

a droplet generation device configured to supply droplets;

a charge supply device configured to selectively charge the droplets to generate a charged droplet and an uncharged droplet a deflection device configured to deflect a trajectory of the charged droplet only toward the emission point; and a trajectory correction device comprising quadrupole magnets disposed surrounding a trajectory of the deflected droplet for correcting the trajectory of the deflected droplet so that the deflected droplet reaches the emission point;

wherein the droplet generation device is inclined with respect to a trajectory toward the emission point, so that the trajectories of droplets leaving the droplet generation device are inclined with respect to a trajectory toward the emission point.

8. An extreme ultraviolet (EUV) light source device for irradiating a droplet at an emission point with externally supplied laser light to turn the droplet into plasma from which the EUV light is emitted, the EUV light source device comprising:

a droplet generator configured to supply droplets;

a charge supply device configured to selectively charge the droplets to generate a charged droplet and an uncharged droplet;

a charging controller configured to provide a driving voltage to the charge supply device in synchronization with the laser light;

a deflection device configured to deflect a trajectory of the charged droplet only toward the emission point; and an electrostatic lens configured to correct the trajectory so that the deflected droplet reaches the emission point, the electrostatic lens comprising first to third electrodes arranged along the trajectory of the deflected droplet the first electrode being applied with a first voltage, the second electrode being applied with a second voltage, and the third electrode being applied with the first voltage;

wherein the droplet generation device is inclined with respect to a trajectory toward the emission point, so that the trajectories of droplets leaving the droplet generation device are inclined with respect to a trajectory toward the emission point.

9. The EUV light source device according to claim 8, further comprising a lens for collecting the externally supplied laser light to the emission point.

10. The EUV light source device according to claim 8, wherein the droplet generator includes a piezoelectric element.

11. The EUV light source device according to claim 8, wherein the electrostatic lens has a doublet configuration comprising two quadrupole electrodes.

12. The EUV light source device according to claim 8, wherein the electrode lens has a triplet configuration comprising three quadrupole electrodes.

13. The EUV light source device according to claim 8, wherein further comprising a debris shield magnet for mitigating debris to be generated in association with the generation of the EUV light.

14. An extreme ultraviolet (EUV) light source device for irradiating a droplet at an emission point with externally supplied laser light to turn the droplet into plasma from which the EUV light is emitted, the EUV light source device comprising:

a droplet generator configured to supply droplets;

a charge supply device configured to selectively charge the droplets to generate a charged droplet and an uncharged droplet;

a deflection device configured to deflect a trajectory of the charged droplet only toward the emission point; and a trajectory correction device comprising quadrupole electrodes each arranged to surround a trajectory of the deflected droplet to correct the trajectory so that the deflected droplet reaches the emission point;

wherein the droplet generation device is inclined with respect to a trajectory toward the emission point, so that the trajectories of droplets leaving the droplet generation device are inclined with respect to a trajectory toward the emission point.

15. The EUV light source device according to claim 1, wherein the deflection device is configured to continuously be energized to deflect the trajectory of the charged droplet toward the emission point.

* * * * *